United States Patent [19]

Goldammer

[11] Patent Number: 4,475,269

[45] Date of Patent: Oct. 9, 1984

[54] SUCTION DUCT FOR TEXTILE MACHINES

[75] Inventor: Georg Goldammer, Gaimersheim, Fed. Rep. of Germany

[73] Assignee: Schubert & Salzer Aktiengesellschaft Maschinenfabrik, Ingolstadt, Fed. Rep. of Germany

[21] Appl. No.: 460,120

[22] Filed: Jan. 21, 1983

[30] Foreign Application Priority Data

Feb. 20, 1982 [DE] Fed. Rep. of Germany ..... 3206257

[51] Int. Cl.[3] ..... D01G 7/10; B65G 53/26

[52] U.S. Cl. ..... 19/80 R; 241/101 A

[58] Field of Search ..... 19/80 R, 81; 241/101 A

[56] References Cited

U.S. PATENT DOCUMENTS

| | | | |
|---|---|---|---|
| 3,663,993 | 5/1972 | Roberson | 19/80 R |
| 4,365,764 | 12/1982 | Marx | 19/80 R X |
| 4,377,021 | 3/1983 | Peters | 19/80 R |

FOREIGN PATENT DOCUMENTS

| | | |
|---|---|---|
| 2244899 | 5/1981 | Fed. Rep. of Germany . |
| 1385618 | 2/1975 | United Kingdom . |
| 2037830 | 7/1980 | United Kingdom . |

*Primary Examiner*—Louis Rimrodt
*Assistant Examiner*—Judith L. Kravitz
*Attorney, Agent, or Firm*—Julian W. Dority

[57] ABSTRACT

A suction duct for textile machines such as bale-openers which is provided for receiving fibers removed from a bale through a flexible tube. The flexible tube 30 is moved with a carriage 21 over a row of bales when removing fibers therefrom. The fibers passing through the flexible tube 30 are deposited into the suction duct 1 which has a longitudinally extending opening 10 provided in the top thereof. In order to maintain the suction duct closed except for the opening 10' communicating with the flexible tube 30, a flexible cover-strip 4 is moved with the connection-opening 3. The remote end of the cover-strip 4 is fixed.

13 Claims, 6 Drawing Figures

SUCTION DUCT FOR TEXTILE MACHINES

BACKGROUND OF THE INVENTION

The invention relates to a suction duct for textile machines, in particular for a bale-opener. The suction duct possesses a stationary connection-opening and a movable connection-opening which is located in a longitudinal side of the suction duct and is portion of a longitudinal slot. The longitudinal slot can be closed by means of a flexible cover-strip, one end of this strip being fastened at a fixed point.

For drawing off fiber material by suction, the use of a suction duct with stationary and movable connection-openings is known. The stationary opening being for the connection to a pneumatic conveying apparatus and the movable opening being on its upper side. The movable connection-opening, through which the fiber material is led into the suction duct, is a portion of a continuous longitudinal slot (German Offenlegungsschrift No. 2,944,889). The longitudinal slot and, hence, the interior space of this suction duct which, in particular, is intended for a bale-opener, is sealed off with respect to the outside air by means of a flexible cover-strip. The two ends of the cover strip are fastened to the ends of the suction duct. The cover-strip is guided by means of reversing rollers, in a manner such that over a section of the longitudinal slot, it leaves the movable connection-opening free, in the form of an intervening space, and lies, on both sides of this intervening space, in two layers, one upon the other, the upper layer being configured in a manner permitting it to move. This arrangement is intended to enable the intervening space to be shifted with a low expenditure of power.

However, due to the relative movement between the upper strand of the cover-strip and the lower strand, the latter closing the longitudinal slot, this arrangement leads to increased wear on the strip. A further disadvantage is the high material-related expenditure resulting, in particular, from the great length of the cover-strip, the numerous reversing and supporting rollers for the strip, and the extensive sealing arrangements which are necessary in the region of the points at which the strip is reversed, as well as the increased space requirement which is necessary for tensioning the long cover-strip. Moreover, this design of strip-guidance system permits a transport or removal tube at one end of the suction duct. This tube leads to a suction device and is connected laterally and impedes access to the suction duct for maintenance work.

These disadvantages are also exhibited by another known suction duct which is designed in the same manner as the duct just mentioned and which is employed for supplying suction-air to a cleaning or maintenance appliance which can be moved along a textile machine; for example, a knotter, at the individual working positions on the machine (British Pat. No. 1,385,618).

SUMMARY OF THE INVENTION

The object of the present invention is to eliminate the abovementioned disadvantages and to provide a suction duct which can be sealed off with respect to the outside air by means of a cover-strip, in a simple, space-saving and reliable manner without the occurrence at the same time of relative movements, and which can be provided at one of its ends with a connection to a pneumatic conveying apparatus.

According to the invention, the object is achieved in the case of a suction duct of the type initially mentioned by an arrangement wherein the other end of the cover-strip is fastened to a take-up reel, this reel being mounted on a carriage which can be moved along the suction duct.

Due to the fact that the cover-strip is composed of a spring-steel strip, it possesses a transverse stiffness which is sufficient to resist sagging under the action of the sub-atmospheric pressure prevailing in the suction duct. Reinforcing ribs are therefore unnecessary.

In a manner further simplifying the device, the drive of the take-up reel is derived from the drive of the carriage. In order to match the drive and peripheral speeds of the take-up reel, the peripheral speed varying with the reel diameter, the take-up reel is driven via a friction clutch. Due to the fact that the friction clutch is provided with an overrunning mechanism, it can take over the function of braking the take-up reel as the cover-strip is being pulled off. In a preferred embodiment, the suction duct is closed on the side located opposite the stationary connection-opening by means of a lid which can be moved with the carriage. By this means, that portion of the suction duct which is not needed at the time in question remains open and is accessible for inspection and cleaning at any time.

The suction duct is expediently of tubular design. In order to seal off the suction duct more effectively, contact surfaces for the cover-strip are provided with sealing strips, these contact surfaces forming the boundaries of the longitudinal slot. A reliable seal in the region between a tube-connection piece which opens into the movable connection-opening and the take-up reel is obtained by means of an arrangement wherein the longitudinal slot is closed, in this region, by a cover carrying a seal which bears against the cover-strip. In order to prevent flying fibers, settling on the cover-strip, from reaching the take-up reel and penetrating between the windings, a brush is assigned to the cover-strip, as a cleaning device. In the case where the suction duct is used in conjunction with a bale-opener possessing a take-off device which can move in the vertical direction, a tubular line is provided for transporting the fibers, this line leading from the movable connection-opening to the bale-opener and being designed to be flexible, so that it can follow the vertical movement of the take-off device. In order to render the interior of the suction duct accessible, even in the region of that end of the cover-strip which is fastened, the suction duct is closed by a flap, in the vicinity of that end of the cover-strip which is fastened at a fixed point. In a further embodiment, a second take-up reel, for a second cover-strip, is assigned to the take-up reel, at a distance from it, the fixed end of this second cover-strip being fastened at that end of the suction duct which is remote from the stationary connection-opening.

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
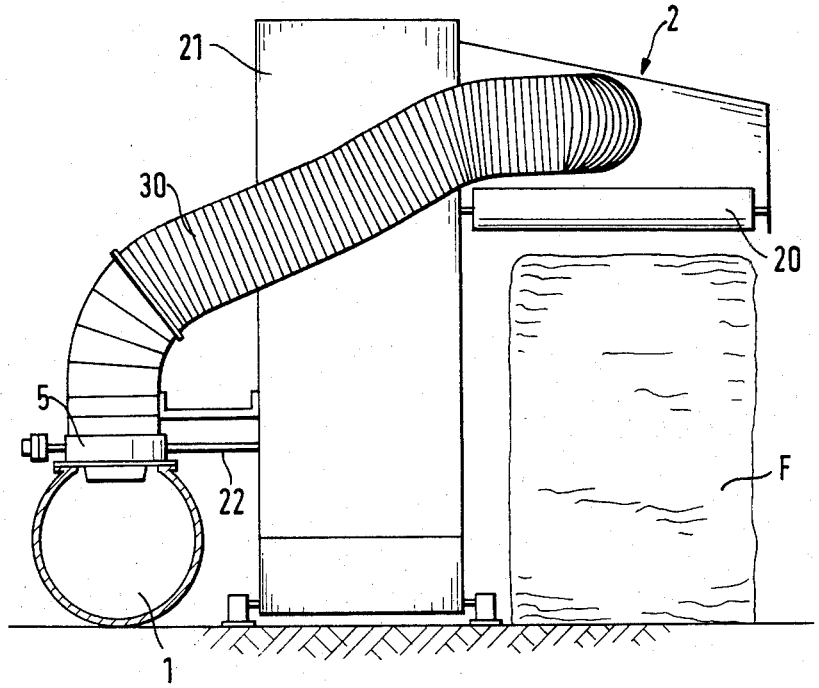
FIG. 1 shows a suction duct in cross-section assigned to a mobile bale-opener.

The suction duct 1, shown in FIG. 1, is employed for drawing-off fiber material by suction from a bale-opener 2 which is removing the fiber material from bales F of fiber. The bales are arranged in a row, one behind another. The bale-opener performs this operation by means of a needlestudded take-off roller 20 or similar device. The suction duct is conceived specifically for this intended application. The take-off roller 20 of the bale opener is mounted in a manner permitting displacement in the vertical direction on a carriage 21 which can be moved along the row of bales.

Figure 3:
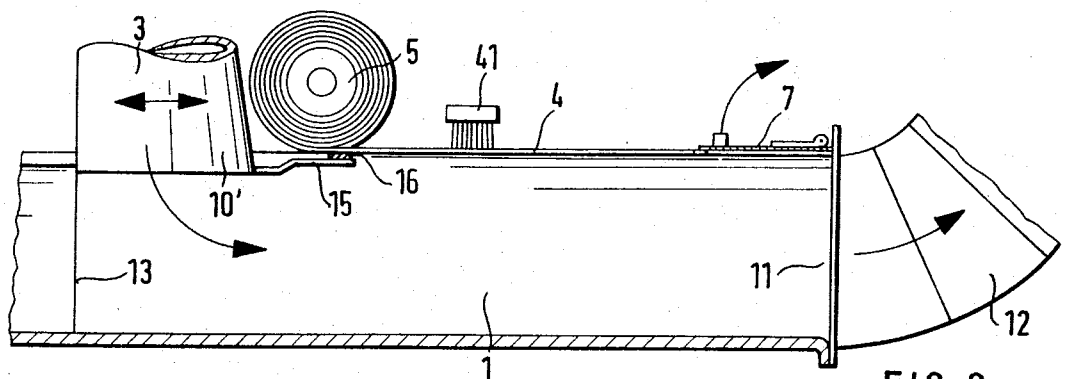
FIG. 3 shows a side view of the suction duct according to FIG. 1 partially in section.
Figure 2:
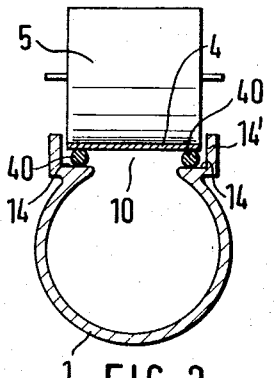
FIG. 2 shows the suctions duct according to FIG. 1, in an enlarged representation.
Figure 4:
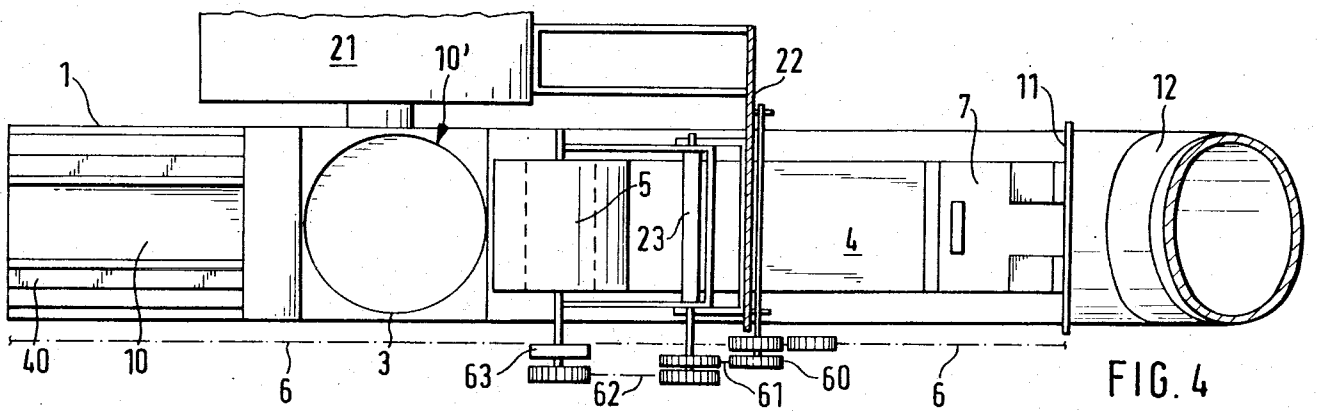
FIG. 4 shows the suction duct according to FIG. 3 in plan view.

The suction duct 1 is of tubular design, and at one end of its ends, possesses a stationary connection-opening 11 (FIGS. 3, 4). A movable connection-opening 10' is present on one longitudinal side of the suction duct 1 in the illustrative embodiment, on the upper side. This connection-opening is a portion of a continuous longitudinal slot 10 (FIGS. 2, 4). A tube-connection piece 3 for a tubular line 30 opens into the movable connection-opening 10', the other end of this tubular line being located above and close to the take-off roller 20 (FIG. 1). The fiber material which is taken from the bales F by the take-off roller 20 is transported through the tubular line 30, into the suction duct 1. The tube-connection piece 3 is fastened to the carriage 21 and, accordingly, follows the movement of the carriage. In order to enable the tubular line 30 which is fastened to the tube-connection piece 3 to follow the vertical movement of the take-off roller 20, the tubular line is composed of a flexible material. The suction duct 1 is connected at its stationary connection-opening 11, to the suction side of a pneumatic conveying apparatus (not shown), this connection being effected by means of a pipe 12 and on the side located opposite the stationary connection-opening 11, the suction duct is closed by a lid 13. The lid 13 is fastened to the tube-connection piece 3 so that it can be moved in the suction duct 1 with this tube-connection piece in the direction of the longitudinal slot 10 (FIG. 3). The lid 13 is matched to the cross-section of the suction duct 1 and is expediently provided on its periphery with a sealing ring which is composed of a flexible material and bears against the inner wall of the suction duct 1 in a manner effecting a seal. For this purpose, the lid 13 can also be designed in the form of a piston.

Over the section between the tube-connection piece 3 and the stationary opening 11 of the suction duct 1, the longitudinal slot 10 is closed by a cover-strip 4 which seals off the interior of the suction duct with respect to the outside air. In order to effect a further improvement in the sealing, the cover-strip 4 rests on sealing strips 40 which are located on contact surfaces 14 of the suction duct 1 (FIG. 2). The contact surfaces are bounded by vertical rims 14', between which the cover-strip 4 is guided. Preferably, a thin spring-steel strip, for example only 0.4 mm thick, is used as the cover-strip 4, its smoothly polished surface presenting little resistance to the air and tending to remain clean. Despite its small thickness, a cover-strip of this type possesses a transverse stiffness which is sufficient to resist sagging under the action of the sub-atmospheric pressure prevailing in the suction duct.

One of the ends of the cover-strip is fastened in the vicinity of the stationary connection-opening 11 of the suction duct 1, and the other end is fastened to a take-up reel 5 which is mounted in the vicinity of the tube-connection piece 3 in a retaining device 22 so that it can rotate and so that it can pivot about a horizontal shaft 23, the retaining device being carried by the carriage 21. In addition, a brush 41 is fastened to the shaft 23 (FIG. 2), the bristles of this brush touching the surface of the cover-strip 4. A cover 15 closes the region between the tube-connection piece 3 and the take-up reel 5, this cover being, for example, a smooth metal plate with a sealing strip 16 arranged thereon as well as sealing devices at the sides. The sealing strip bears against the take-up reel 5 and/or against the cover strip wound thereon, and the sealing devices bear against the duct wall. The drive of the take-up reel 5 required in order to wind up the cover-strip 4 is derived from the drive of the carriage 21. For this purpose, a chain 6 is stretched along the suction duct 1, the ends of this chain being fastened to the ends of the suction duct 1 (FIG. 4). A chainwheel 60 engages into the chain 6, this chainwheel being mounted on the retaining device 22 and being caused to rotate by the traveling movement of the carriage 21. The rotation of the chainwheel 60 is transmitted to the take-up reel 5 via two chain drives, 61 and 62, and via a friction clutch 63.

The friction clutch 63 enables the speed at which the take-up reel 5 is driven, which speed is set for the smallest reel diameter, to be matched to the peripheral speed, the latter changing as the reel diameter increases. In conjunction with an overrunning mechanism, the friction clutch can take over the function of braking the take-up reel 5 as the cover-strip is being pulled off so that the amount of cover-strip which is unwound never exceeds the amount corresponding to the travel of the carriage 21. In the case of this embodiment, the cover-strip for covering the longitudinal slot 10 needs to be only slightly longer than the slot.

When the machine is running, the bale-opener 2 moves along the bales F and the suction duct 1, the fiber material, detached from the bale by the take-off roller 20, being led through the tubular line 30 into the suction duct 1 and being drawn off by suction at the stationary connection-opening 11 of the suction duct. At the same time, as the carriage 21 moves towards the stationary connection-opening 11, the cover-strip 4 closing the longitudinal slot 10 is wound onto the take-up reel 5, this reel being caused to rotate and, if motion is taking place in the opposite direction, the cover-strip is pulled from the take-up reel 5, with concurrent braking of the reel. As a result, depending on the location of the carriage 21, only a greater or smaller section of the suction duct 1 remains closed by the cover-strip 4 and by the lid 13, the latter sliding with the tube-connection piece 3 along the longitudinal slot 10 while that other section of the suction duct 1, which is not required, is freely accessible. As the carriage moves, the interior of the suction duct 1 is cleaned by the lid 13, moving with the carriage. In the same way, before being wound up, the cover-strip 4 is cleaned by the sealing strip which bears against its undersurface, and by the brush 41, on its upper surface so that, overall, the installation has a self-cleaning action. In order to render the interior of the suction duct 1 accessible, even when the cover-strip 4 covers the entire longitudinal slot 10, a flap 7 is provided at the end 11 of the suction duct 1. This flap 7 is located between that end of the cover-strip 4 which is fastened and the pipe 12 which effects the connection to the pneumatic conveying apparatus, and can be manually opened if required.

The arrangement of the cover-strip 4, according to the invention, saves both expense and space, and enables the longitudinal slot 10 to be covered without any relative movement between the cover-strip and the suction duct or, as the case may be, between the cover-strip and the sealing strip 40, as well as permitting free access to the suction duct. In addition, the suction duct 1 can be connected to the pneumatic conveying apparatus in any desired manner, for example, laterally or even directly downwards. Connection in the longitudinal direction of the suction duct, according to FIGS. 3 and 4, is nevertheless preferred for aerodynamic reasons insofar as this is permitted by space-related conditions.

Figure 5:
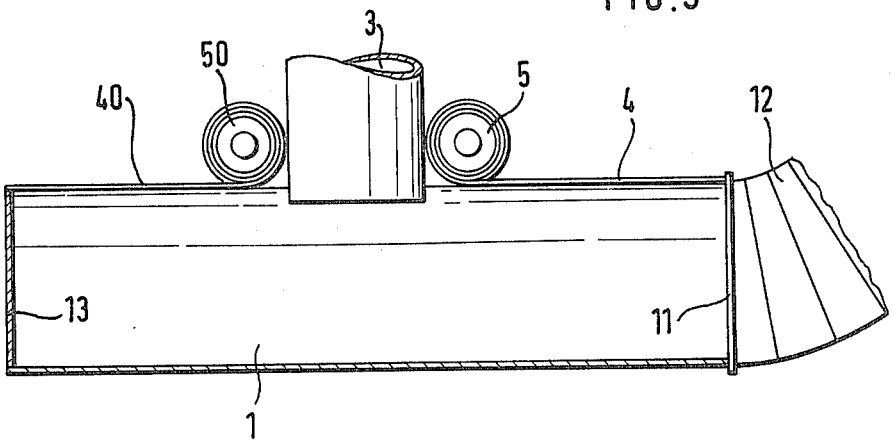
FIG. 5 shows a suction duct with two take-up reels in side view.

In the illustrative embodiment according to FIG. 5, two take-up reels, 5 and 50, are present, each for one cover-strip, 4 and 40 respectively, these take-up reels being located on either side of the tube-connection piece 3 which opens into the suction duct, and hence being located at a distance one from the other. One of the ends of the second cover-strip 40 is fastened to that end of the suction duct 1 which is located opposite the stationary connection-opening 11, and the other end is fastened to the take-up reel 50. The second take-up reel 50 is mounted and driven in a manner corresponding to the arrangements for mounting and driving the take-up reel 5, as described by reference to FIGS. 3 and 4. Here the lid 13, closing the suction duct 1 at its end located opposite the stationary connection-opening 11, is designed to be stationary. This arrangement, in which it is possible to provide a cleaning flap at one end of the suction duct 1, or even at both ends, likewise enables the longitudinal slot to be covered by unrolling the cover-strip, 4 or 40, from the take-up reel, and to effect a connection, adapted to the space-related conditions, to the pneumatic conveying apparatus. The embodiment according to FIGS. 1 to 4 is however preferred for cost-related reasons and because it provides unobstructed accessibility to the suction duct.

Figure 6:
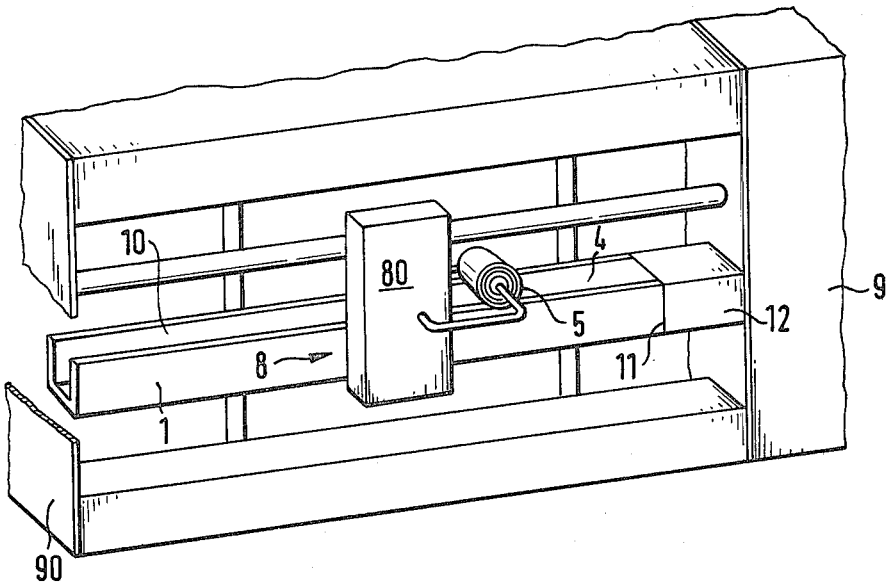
FIG. 6 shows a suction duct which is assigned to a mobile maintenance appliance on a textile machine.

The use of the suction duct is not restricted to drawing-off fiber material by suction. The suction duct can also be assigned to a maintenance or cleaning appliance 8, which requires a stream of suction-air and which can be moved by means of a carriage 80 on the suction duct 1 which is mounted between the end-frames 9, 90 of a textile machine and is formed by a U-shaped profile section (FIG. 6). The applicance can communicate with the interior space of the suction duct 1 by means of, for example, a connection tube which is assigned to the longitudinal slot 10.

The lid which closes the suction duct 1 at the end located opposite the stationary connection-opening 11, and which cannot be seen, is rigidly connected to the carriage 80 and can be moved with this carriage. The take-up reel 5 is mounted on the carriage 80 in a manner permitting rotation and so that it can pivot about a horizontal shaft. The cover-strip 4 closes the longitudinal slot 10 between the carriage 80 and the connection 12 to the pneumatic conveying apparatus, the slot being located on the top of the suction duct 1. One end of the cover-strip 4 is fastened at that end of the suction duct 1 which possesses the stationary connection-opening 11, and the other end is fastened to the take-up reel 5. The means for driving the take-up reel correspond to those shown in FIG. 4 so that their description has been dispensed with.

The installation according to the invention can be modified, for example by providing the longitudinal slot 10 on the side of the suction duct 1. The installation can then be used even in the case of a suction duct which is arranged in an arc. The outlet of the tube-connection piece 3 into the movable connection opening 10' can likewise be configured with an elongate cross-section instead of a circular cross-section, this arrangement enabling the width of the longitudinal slot 10 to be reduced and hence the width of the cover-strip 4 to be reduced as well.

What is claimed is:

1. A suction duct for textile machines, in particular for a bale-opener, said suction duct possessing a stationary connection-opening and a movable connection-opening which is located in a longitudinal side of the suction duct and is a portion of a longitudinal slot which can be closed by means of a flexible cover-strip, one end of this strip being fastened at a fixed point, wherein the other end of the cover-strip (4) is fastened to a take-up reel (5), this reel being mounted on a carriage (21,80) which can be moved along the suction duct (1).

2. The suction duct as claimed in claim 1, wherein the cover-strip (4) is composed of spring steel.

3. The suction duct as claimed in claim 1 wherein the drive of the take-up reel (5) is derived from the drive of said carriage (21, 80).

4. The suction duct as claimed in claim 1 wherein said take-up reel (5) is driven via a friction clutch (63).

5. The suction duct as claimed in claim 4, wherein said friction clutch (63) is provided with an over-running mechanism.

6. The suction duct as claimed in claim 1 wherein the suction duct (1) is closed on the side located opposite the stationary connection-opening (11), by means of a lid (13) which can be moved with the carriage (21, 80).

7. The suction duct as claimed in claim 1 further comprising said suction duct being of tubular design.

8. The suction duct as claimed in claim 1 wherein contact surfaces (14) for the cover-strip (4) are provided with sealing strips (40), these contact surfaces forming the boundaries of the longitudinal slot (10).

9. The suction duct as claimed in claim 1 wherein the longitudinal slot (10) is closed in the region between a tube-connection piece (3) which opens into a movable connection-opening (10') and said take-up reel (5), by a cover (15) carrying a seal (16) which bears against the cover-strip (4).

10. The suction duct as claimed in claim 9 further comprising:

a flexible tubular line leading from said movable connection-opening (10') to said bale-opener.

11. The suction duct as claimed in claim 1 wherein a brush (41) is assigned to the cover-strip (4) as a cleaning device.

12. The suction duct as claimed in claim 1, said suction duct (1) being closed by a flap (7), in the vicinity of that end of the cover-strip (4) which is fastened at a fixed point.

13. The suction duct as claimed in claim 1 further comprising a second take-up reel (50), for a second cover-strip (40), is assigned to the take-up reel (5), at a distance from it, the fixed end of said second cover-strip being fastened at that end of the suction duct (1) which is remote from the stationary connection-opening (11).

* * * * *